US012398524B1

(12) United States Patent
Jones et al.

(10) Patent No.: US 12,398,524 B1
(45) Date of Patent: Aug. 26, 2025

(54) RESILIENT BAND MOUNTING SYSTEM

(71) Applicants: Michael Howard Jones, Statington, PA (US); Matthew Richard Jones, Emmaus, PA (US)

(72) Inventors: Michael Howard Jones, Statington, PA (US); Matthew Richard Jones, Emmaus, PA (US)

( * ) Notice: Subject to any disclaimer, the term of this patent is extended or adjusted under 35 U.S.C. 154(b) by 81 days.

(21) Appl. No.: 18/583,683

(22) Filed: Feb. 21, 2024

Related U.S. Application Data

(60) Provisional application No. 63/447,631, filed on Feb. 22, 2023.

(51) Int. Cl.
*E02B 3/26* (2006.01)

(52) U.S. Cl.
CPC ..... *E02B 3/26* (2013.01)

(58) Field of Classification Search
CPC ..... E02B 3/20; E02B 3/24; E02B 3/26; E02B 3/28
See application file for complete search history.

(56) References Cited

U.S. PATENT DOCUMENTS 6,220,916 B1 * 4/2001 Bart ..... A63H 33/00 446/26
2013/0291586 A1 11/2013 Koeppel
2013/0321759 A1 * 12/2013 Allen ..... G02C 3/04 351/114
2019/0328089 A1 10/2019 Livera
2024/0365968 A1 * 11/2024 Axelrod ..... A46B 9/023

FOREIGN PATENT DOCUMENTS

DE 102016115537 A1 * 2/2018 ..... H02G 3/0481

* cited by examiner

*Primary Examiner* — Kyle Armstrong
(74) *Attorney, Agent, or Firm* — Jake M. Gipson; Stephen H. Hall; Bradley Arant Boult Cummings LLP

(57) ABSTRACT

A resilient band mounting system comprises a bistable spring band with a through hole having a straight position and a coiled position, and a pin secured in the through hole. The system preferably includes at least one bracket disposed around the band on one side of the through hole. The resilient band mounting system is attached to an object, such as a portable dock bumper, to be mounted on a pole, post, or similar structure. The portable dock bumper includes at least one through hole in which the pin is also engaged, thus securing the resilient band mounting system to the bumper. When the band is in the straight position, the resilient band mounting system may be secured to a pole or post by pressing the band against the pole or post, which causes the band to spring into the coiled position and wrap around the pole or post.

20 Claims, 6 Drawing Sheets

RESILIENT BAND MOUNTING SYSTEM

CROSS-REFERENCE TO RELATED APPLICATIONS

This application claims the benefit of and priority to U.S. Provisional Patent Application No. 63/447,631, entitled "Resilient Band Mounting System" and filed on Feb. 22, 2023. The entire contents of the foregoing application are incorporated by reference.

FIELD OF THE DISCLOSURE

The present disclosure relates to attachment mechanisms for securing devices to poles, posts, and other similar structures, and more particularly to devices to securing devices to docks and other marine structures.

BACKGROUND OF THE INVENTION

Docks are commonly constructed from wood, metal, or a combination thereof. These materials can easily scratch or damage the gel coats, fiberglass, and other materials from which boats and other marine vessels are constructed. As a result, when docking vessels, owners desire to prevent their vessels from becoming damaged by slamming into or otherwise making contact with the structure of a dock.

The currently available solutions fall into two broad categories. The first category includes semi-permanent bumpers affixed to the dock. These bumpers are often constructed from rubber or hard plastic and are secured to the dock using screws, bolts, or another fastener. While these bumpers may provide satisfactory protection in the area in which they are installed, they cannot be repositioned easily. Thus, a dock owner must install bumpers in every location at which a boat may be docked, and the bumpers cannot be transported when using another dock.

The other category includes portable boat fenders. These fenders are often cylindrical shaped and constructed from a rubber or soft plastic material. Sometimes they are inflatable or filled with another material. Fenders are intended to be temporarily installed between a boat and a dock structure. The fenders commonly include a rope or another temporary attachment means, which can be secured to the boat (such as to its cleats) or to the dock (such as to its cleats or dock poles). The boat owner or dock owner must tie the rope or other attachment means at the right length and location to position the fender in a way that the vessel will contact only the fender and not the dock. Thus, although this configuration allows fenders to be portable, they are often difficult to install in a way that ensures the boat will not make contact with the dock.

Consequently, there is a need in the art for an improved mounting system for boat fenders, dock bumpers, and other dock accessories. Preferably, the mounting system would include an attachment means that allows for quick attachment in a location that provides a boat with reliable protection from the structure of a dock. Even more preferably, the mounting system can be easily removed and repositioned to a different location or to a different dock altogether.

SUMMARY OF THE INVENTION

This disclosure describes a resilient band mounting system, including as used in connection with a portable dock bumper. Advantageously, embodiments of the resilient band mounting system may be quickly installed on a post, pole, or other similar structure, including posts or poles having a circulate, square, or rectangular cross section. The resilient band mount system can also be easily removed and reinstalled in a different position or at a different location without the use of any tools or cumbersome tying of ropes. In a preferred embodiment, the resilient band mounting system is incorporated into a portable dock bumper. The portable dock bumper can be easily installed and repositioned on the post or pole of a dock. Embodiments of the invention may thus satisfy one or more, but not necessarily all, of the needs and capabilities described throughout this disclosure.

In some embodiments, the portable dock bumper comprises (1) a bumper body having a front surface for engaging a vessel and a rear surface for engaging a dock structure, wherein a first through hole extends through the body from the front surface to the rear surface; (2) a bistable spring band having a first straight position and a second coiled position, wherein the bistable spring band has a height and a through hole located at approximately the midpoint of the height; (3) a pin disposed in the through hole of the band and the through hole of the body, wherein the pin secures the band to the body; and (4) a first bracket disposed around the band on one side of the through hole of the band. Preferably, a second bracket is also disposed around the band on the opposite side of the first bracket, and more preferably, a second assembly of a bistable spring band, pin, and brackets is attached to the bumper body.

In another embodiment, the resilient band mounting system comprises (1) a bistable spring band having a first straight position and a second coiled position, wherein the bistable spring band has a height and a through hole located at approximately the midpoint of the height; and (2) a pin secured in the through hole. The system preferably further comprises a pair of brackets disposed around the band on each side of the through hole. In a particular embodiment, the pin comprises a removable end cap that is replaceable with another end cap having a different length.

In yet another embodiment, a method of installing an object on a post or pole comprises (1) providing an object having a through hole and comprising: a bistable spring band having a first straight position and a second coiled position, wherein the bistable spring band has a height and a through hole located at approximately the midpoint of the height; and a pin disposed in the through hole of the band and the through hole of the object, wherein the pin secures the band to the object; (2) placing the band in the first straight position; and (3) placing the band against a post or pole and applying pressure to the band to spring the band into said second coiled position. The method may further comprise (4) returning the band to the first straight position; (5) removing the end cap and replacing either the end cap or the pin with a different end cap or different pin; and placing the band against the post or pole and applying pressure to the band to spring the band into the second coiled position.

The above summary presents a simplified summary to provide a basic understanding of some aspects of the claimed subject matter. This summary is not an extensive overview. It is not intended to identify key or critical elements or to delineate the scope of the claimed subject matter. Its sole purpose is to present some concepts in a simplified form as a prelude to the more detailed description that is presented later.

DEFINITIONS

Figure 1:
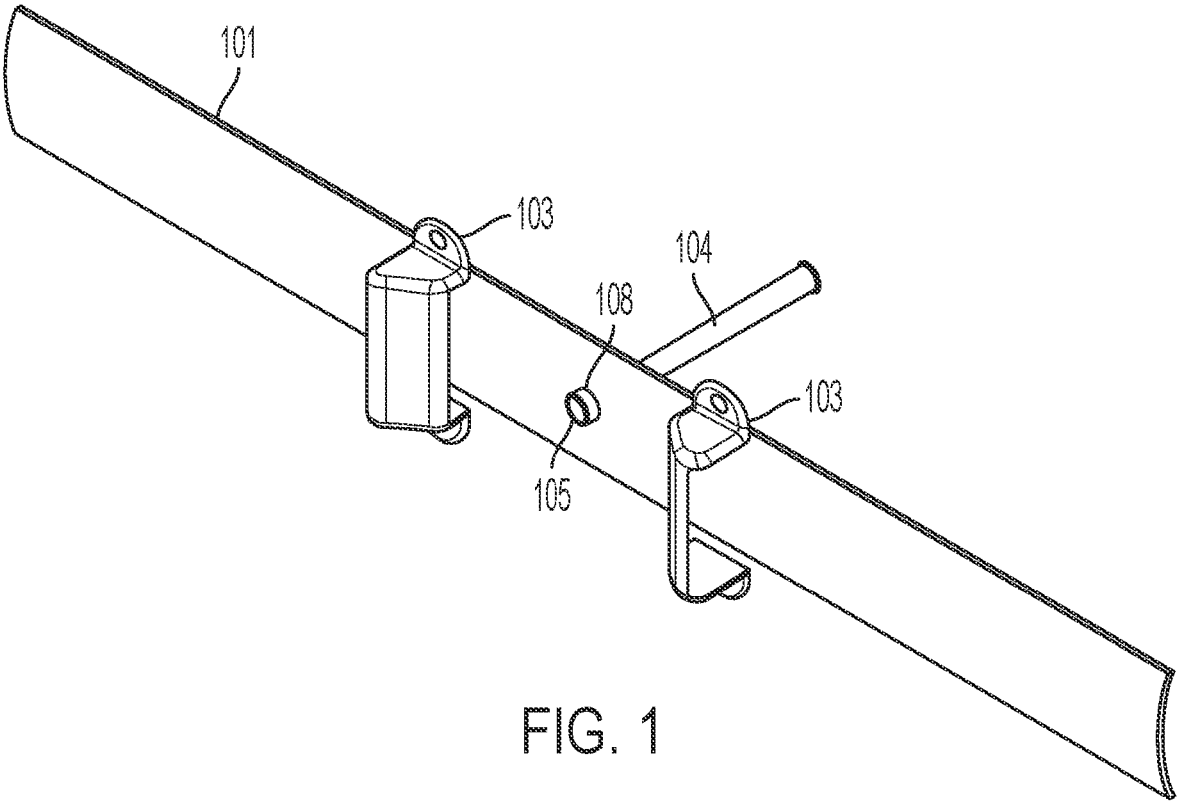
FIG. 1: A perspective view of the resilient band mounting system in the open (straight) state.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a," "an," and "the" are intended to include the plural forms as well, unless the context clearly indicates otherwise.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure. Likewise, terms such as "top" and "bottom" are used to distinguish certain features or elements from each other, but it is expressly contemplated that a top could be a bottom, and vice versa.

The term "consisting essentially of" means that, in addition to the recited elements, what is claimed may also contain other elements (steps, structures, ingredients, components, etc.) that do not adversely affect the operability of what is claimed for its intended purpose as stated in this disclosure. This term excludes such other elements that adversely affect the operability of what is claimed for its intended purpose as stated in this disclosure, even if such other elements might enhance the operability of what is claimed for some other purpose.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The following description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but as mentioned above, it is to be understood that the teachings of the present disclosure are capable of use in various other combinations, modifications, and environments and are capable of changes or modifications within the scope of the teachings as expressed herein, commensurate with the skill and/or knowledge of a person having ordinary skill in the relevant art. The embodiments described are further intended to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational cues. These headings shall not limit or characterize the invention(s) set forth herein.

DETAILED DESCRIPTION

A resilient band mounting system has been developed and is described in this disclosure. The resilient band mounting system is particularly advantageous for use with a portable dock bumper, and particular improvements related to an improved portable dock bumper are also described in this disclosure. But the teachings are not limited to such applications, and the resilient band mounting system may be used with a wide array of dock accessories and other objects, such as objects intended to be installed on pier posts, telephone poles, metal tubing, lamp posts, fence posts, or other poles.

Figure 2:
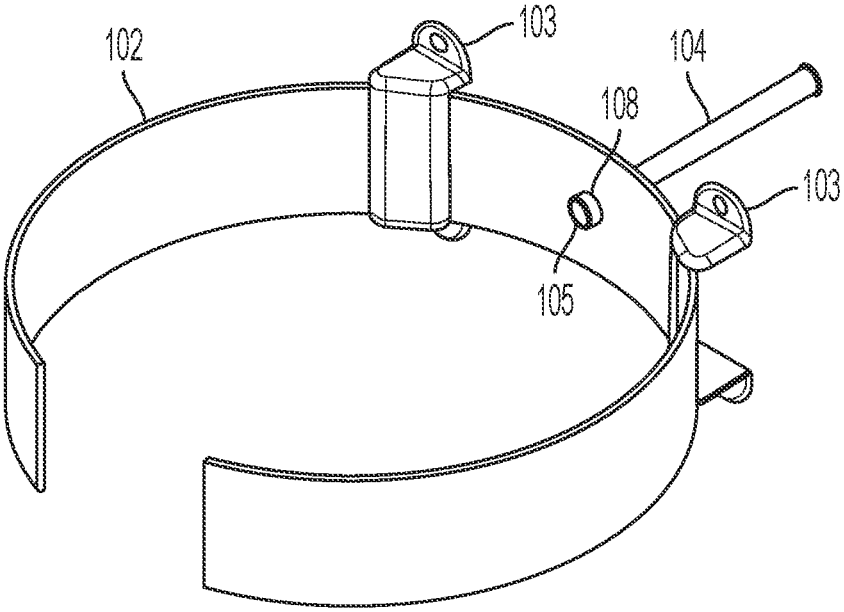
FIG. 2: A perspective view of the resilient band mounting system in the closed (coiled) state.
Figure 4:
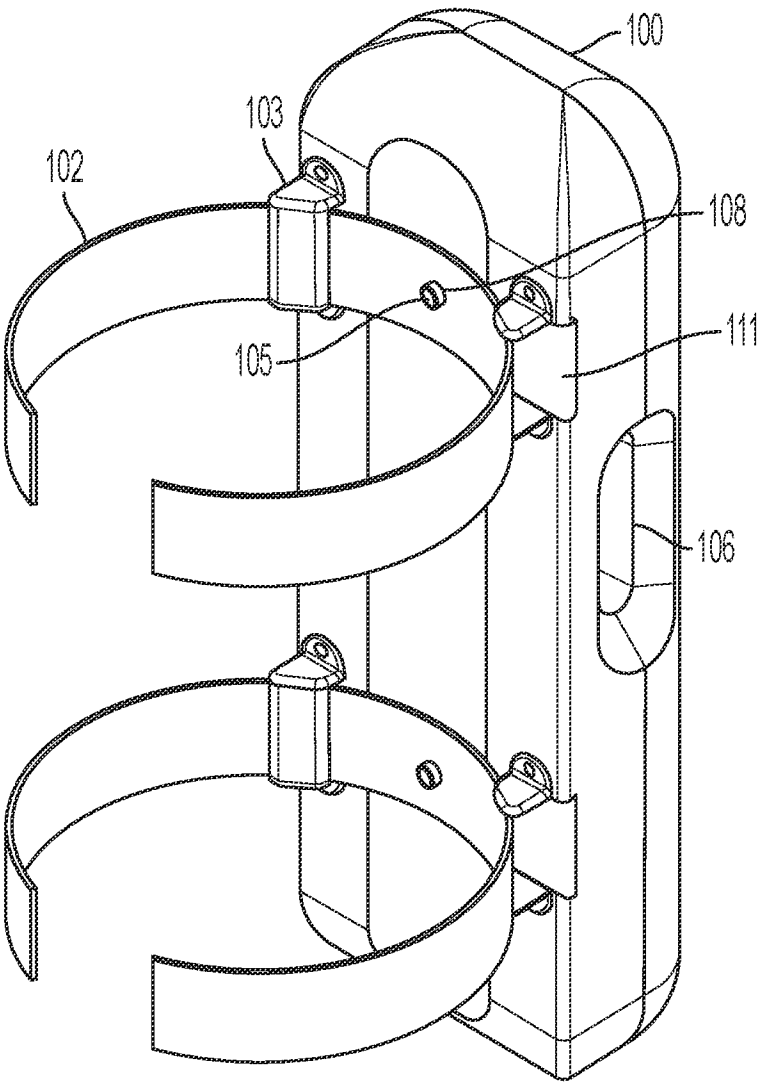
FIG. 4: A rear perspective view of a portable dock fender with a resilient band mounting system in the closed (coiled) state.
Figure 3:
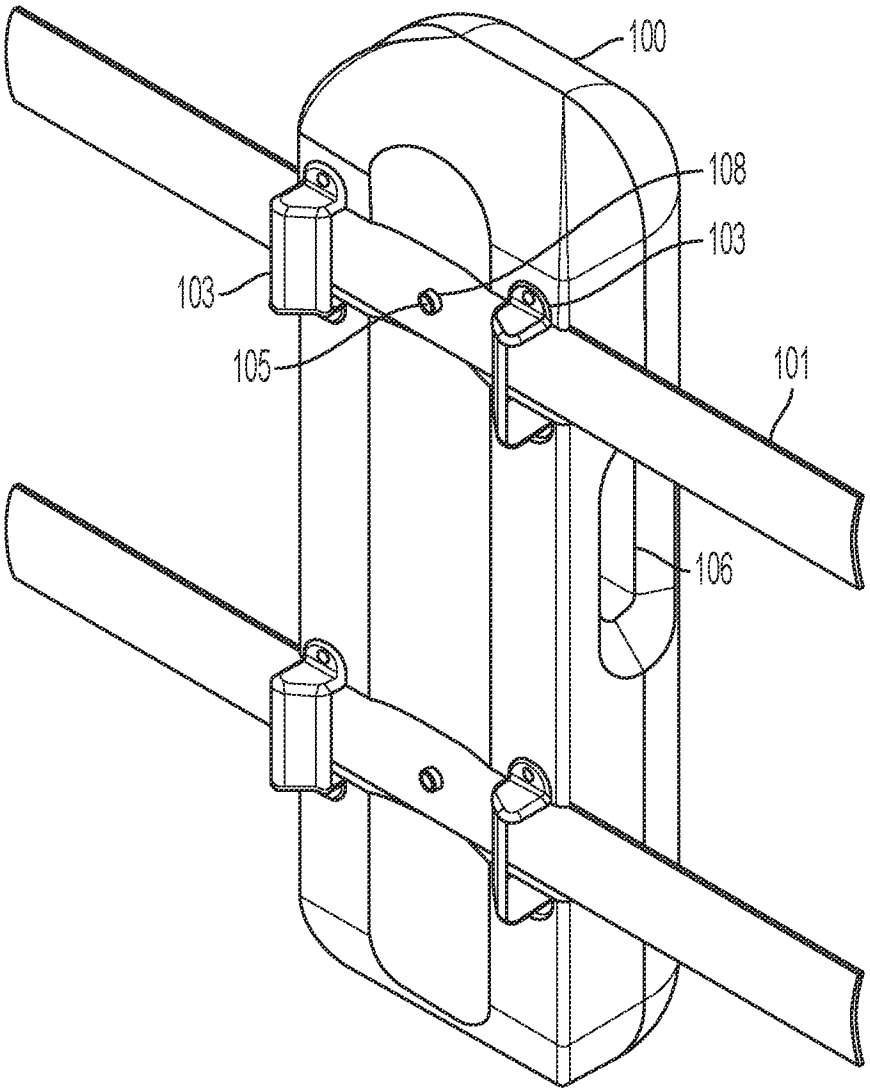
FIG. 3: A rear perspective view of a portable dock fender with a resilient band mounting system in the open (straight) state.
Figure 6:
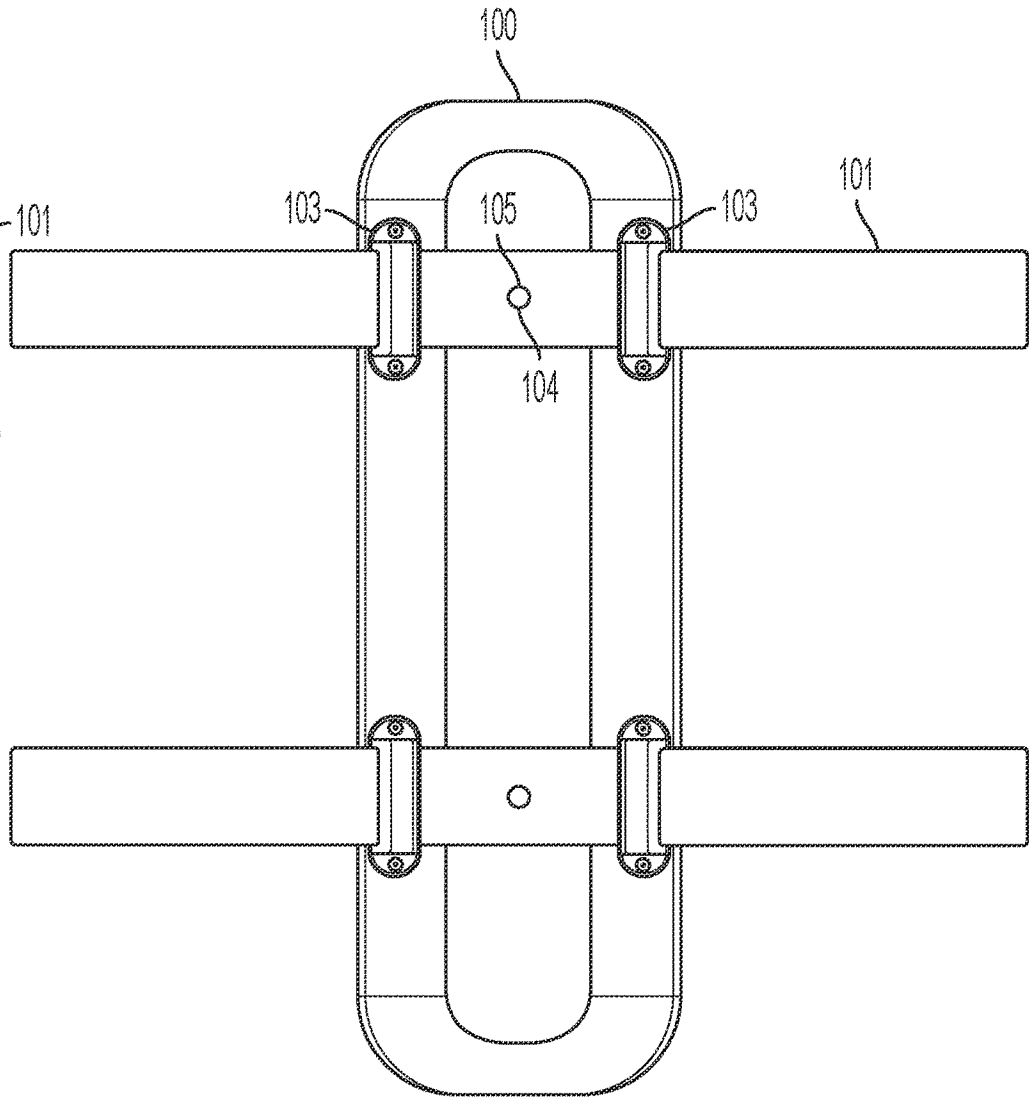
FIG. 6: A rear view of a portable dock fender with a resilient band mounting system in the open (straight) state.
Figure 5:
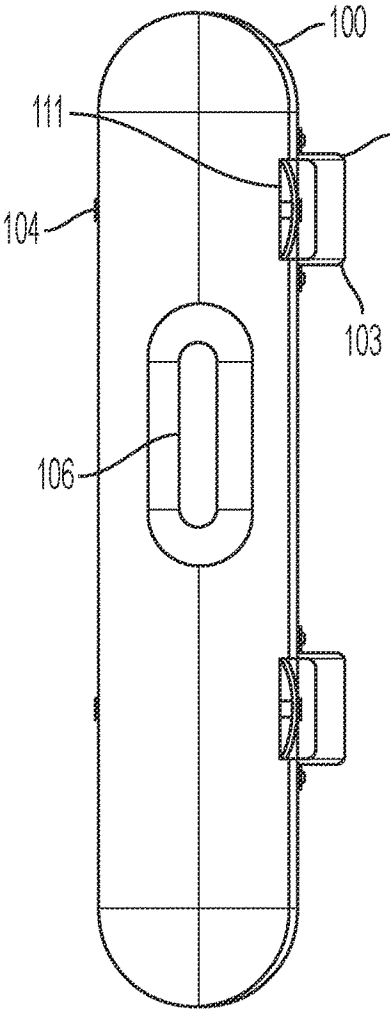
FIG. 5: A side view of a portable dock fender with a resilient band mounting system in the open (straight) state.
Figure 8:
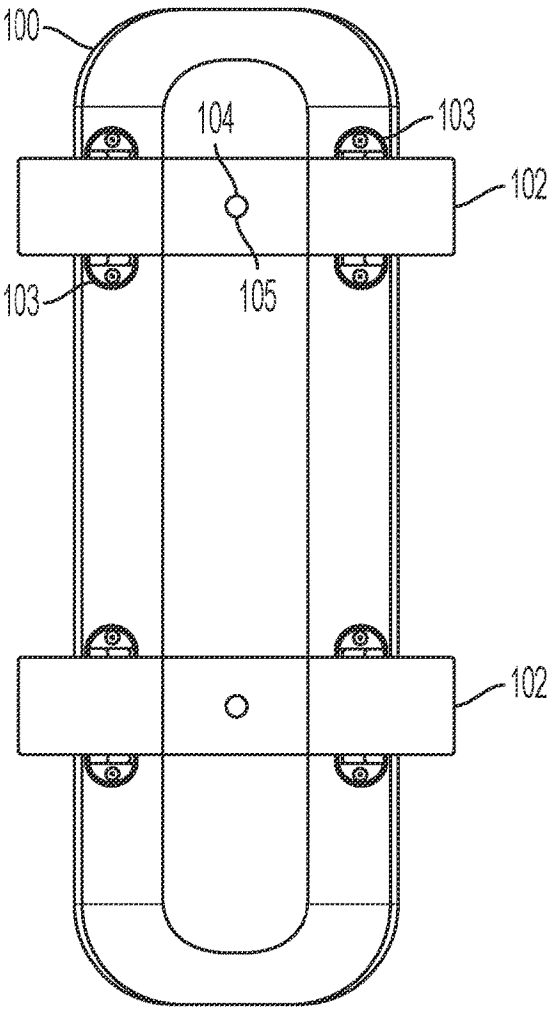
FIG. 8: A rear view of a portable dock fender with a resilient band mounting system in the closed (coiled) state.

An exemplary embodiment of the resilient band mounting system is shown in FIGS. 1 and 2. In this embodiment, the resilient band mounting system comprises a bistable spring band 101 and a pin 104 with an end cap 105. The resilient band mounting system preferably has at least one bracket 103, and more preferably two brackets 103, secured around the band 101. The resilient band mounting system may be attached to various objects, including a portable dock bumper 100. An exemplary embodiment of a portable dock bumper 100 including two resilient band mounting systems is shown in FIGS. 3-11. Numerous variations of the resilient band mounting system and portable dock bumper are possible. Each component of the system and bumper are further described below.

The bistable spring band 101 is preferably constructed from metal, such as stainless steel or another variety of steel. In a preferred embodiment, the metal bistable spring band is coated with a protective material, such as a fabric or a polyurethane coating. Any suitable protective material may be used. In some embodiments, the protective material is selected to protect users from sharp surfaces on the metal, to protect the metal band from the elements, or to increase the friction when the band contacts a dock post or other material.

The spring band has two stable states. In the first stable state, the band is in the opened or straight position 101, as shown in FIG. 1. When in the opened or straight position, the band is approximately straight along its length or longitudinal axis, but it is not flat. Along its height or transverse axis, the band is slightly curved, as shown in FIG. 1. The band may be transitioned to the second stable state by depressing or flattening the band anywhere along its length. Doing so causes the band to spring into the second stable state. In the second stable state, the band is in a closed or coiled state 102, as shown in FIG. 2. When in this state, the band is flat along its height or transverse axis but is in a curved or circular shape along its length or longitudinal axis. To return the band 102 to the opened or straight state, each end of the band must be pulled apart and a slight bend must be imparted along the height or transverse axis of the band.

The dimensions of the spring band 101—i.e. thickness, length, and height-vary depending on the application. For instance, in embodiments where the object is intended to be installed on a post having a relatively small diameter, a spring band 101 with a shorter length may be selected. In one preferred embodiment, the spring band has a length between about 4 inches and about 36 inches, and a height between about 0.25 inches and about 4 inches.

The spring band 101 includes at least one through hole 108. Preferably, the through hole 108 is located around the midpoint of the height of the band 101. In this configuration, if the pin 104 in the through hole 108 is pushed inwardly when the band is in the opened or straight state 101, the pin 104 depresses the slight curve of the band and causes the band to change to the closed or coiled state 102. Furthermore, in embodiments where only a single pin 104 secures the band 101 to the bumper 100 or other object, the through hole 108 is preferably located around the midpoint of the length of the band 101. In other words, the through hole 108 is located at approximately the center of the band 101. But in some embodiments, the band 101 may include a second through hole 108 and be secured to the bumper 100 or other object using an additional second pin. In those embodiments, the two through holes 108 are preferably located on each side of a medial line, where the medial line is defined as the midpoint of the length of the band 101.

At least one pin or connection rod 104 secures the band 101 to the bumper 100 or other object. The pin 104 may be construed from any suitable material, such as metal or plastic. The pin 104 has a diameter that is at least slightly less than the diameter of the through hole 108 of the band 101.

In a preferred embodiment, the pin 104 includes an end cap 105 on the end of the pin 104 proximate to the band 101. The end cap 105 may be constructed from plastic, such as injection molded plastic, or metal. The end cap 105 is dimensioned to have a width or diameter that is greater than the diameter of the through hole 108, which prevents withdrawal of the pin 104 from the through hole 108. In some embodiments, the end cap 105 is removable. In one exemplary embodiment of the removable end cap 105, the end of the pin 104 is threaded and the removable end cap 105 includes a complementary set of threads to secure the end cap 105 on the pin 104. Alternatively, the end cap 105 may include a small through hole, through which a screw or bolt may be inserted and then screwed into the pin 104. In embodiments with a removable end cap 105, the resilient band mounting system may be provided with an assortment of end caps for different use applications. For instance, some end caps may have a shorter or greater length, which may be selected based on the diameter or width of the post or pole to which the resilient band mounting system is to be attached. By changing the length of the end cap, the user may adjust whether the end cap 105 contacts the post or pole when the band 102 is in the closed position and the extent of gripping force provided around the post or pole.

In other embodiments, however, the end cap 105 is not removable and may be integrally formed on the pin 104. For instance, a flange may be integrally formed around the perimeter of the end of the pin 104. In such embodiments, the other end of the pin 104 may be removable to allow for separation of the band 102 from the bumper 100 or other object. But in some embodiments, the pin 104 is not removable.

The resilient band mounting system may also include at least one bracket 103, and more preferably two brackets 103, to secure the band 101 and hold it in place. The brackets 103 may be formed from any suitable material, such as metal or plastic. In some embodiments where the bumper 100 or other object is a molded plastic or similar material, the brackets 103 are integrally molded into the body of the bumper 100. Alternatively, the brackets 103 may be separate parts affixed to the body of the bumper 100 using fasteners, such as screws or bolts. In some embodiments, the outer surface of the brackets—the surface that contacts the post or pole—includes a structure to increase friction, such as a rough surface or a surface with raised dimples or similar features.

Each bracket 103 forms a channel through which the band 101 may be inserted and held in place. In embodiments where the brackets 103 are separate parts secured to the body of a bumper 100, the brackets may be generally U-shaped. That is, the bracket 103 is secured to the bumper body 100 at each of its ends, and in between the ends, the middle section of the bracket is raised from the surface of the body to form a slot in which the band 101 may be held between the bracket and the bumper body 100. Alternatively, in embodiments where the brackets are integrally molded into the body of a bumper, the brackets may comprise slots molded into the body.

The brackets 103 are preferably dimensioned to complement the shape of the band in both the opened or straight state 101 and the closed or coiled state 102. The brackets 103 preferably have a slot height that is slightly larger than the height of the band 101 to hold the resilient band approximately horizontally. The slots formed by the brackets 103 also have an opening of sufficient width to accommodate the band in both the straight 101 and coiled 102 states. In some embodiments, such as shown in FIGS. 1 and 2, the width of the slots is greater on the outer edges of the slots and the width decreases towards the interior of the slots.

In one preferred embodiment, the resilient band mounting system is attached to a bumper body 100. The bumper body 100 may be constructed from any suitable material, including any of the materials from which traditional dock bumpers or boat fenders are constructed. (Although this disclosure generally uses the term "bumper" to refer to the object cushioning a vessel from directly contacting a dock, that terminology is used for convenience and is not intended to imply the object could not also be termed a "fender.") Exemplary materials include polyvinylchloride or flexible rubber. In some embodiments, the bumper may comprise, in part, a plastic or rubber material that is inflatable with air. The bumper may alternatively be filled with foam or another material that provides shock absorption. In other embodiments, the bumper is constructed from a hard plastic material. Preferably, the bumper is buoyant, including after the resilient band mounting system is installed thereon, so that the bumper floats if it is inadvertently dropped into the water.

The bumper body 100 is preferably an elongated shape. In some embodiments, the bumper body 100 is cylindrical, generally cylindrical, semi-cylindrical, generally semi-cylindrical, cuboid, or generally cuboid in shape. In preferred embodiments, the bumper body 100 has a height between about 6 inches and about 96 inches and a width between about 6 inches and 24 inches.

The bumper body 100 includes at least one through hole for attaching a resilient band mounting system. The through hole has a diameter that is at least slightly greater than the diameter of the pin 104. At the end of the pin 104 opposite of the end cap 105, the pin 104 includes a retaining structure to prevent withdrawal of the pin 104 from the through hole of the body 100. In some embodiments, the retaining structure comprises a flange around the perimeter of the end of the pin 104, but the pin 104 may also comprise a second end cap or another structure, such as a cotter pin, to prevent withdrawal of the pin 104.

Preferably, the bumper includes at least two resilient band mounting systems. In this embodiment, the bumper body 100 includes a first through hole in its upper section and a second through hole in its lower section that is vertically aligned with the first through hole. Generally speaking, the upper and lower resilient band mounting systems in this embodiment are mirror images of each other.

Each band 101 is secured to the bumper body 100 by at least one pin 104. In a preferred embodiment, each band 101 is also secured to the bumper body 100 by a pair of brackets 103. The brackets 103 are secured to the bumper body 100 on opposite sides of the through hole. Alternatively, in some embodiments, only a single bracket 103 is used, or each band 101 may be secured using a pair of pins 104, which are installed in a pair of through holes in both the band 101 and a pair of through holes in the bumper body 100.

The bumper body 100 includes a front surface 109 for engaging a vessel and a rear surface 110 for engaging a dock structure. In a preferred embodiment, the rear surface 109 includes a recessed surface for engaging a dock post or other structure. The recess is preferably concave in shape, with the deepest part of the recess aligned with the location of the through hole in the body 100. The recess decreases in depth in a direction toward each side of the body 100. The concave recess preferably extends across the rear surface 110 from approximately the top to the bottom of the body. In some embodiments, the rear surface may include a recessed slot 111 associated with each band 101. The recessed slot 111 extends transversely across the rear surface 110 and has a height approximately equal to the height of the band 101.

Figure 7:
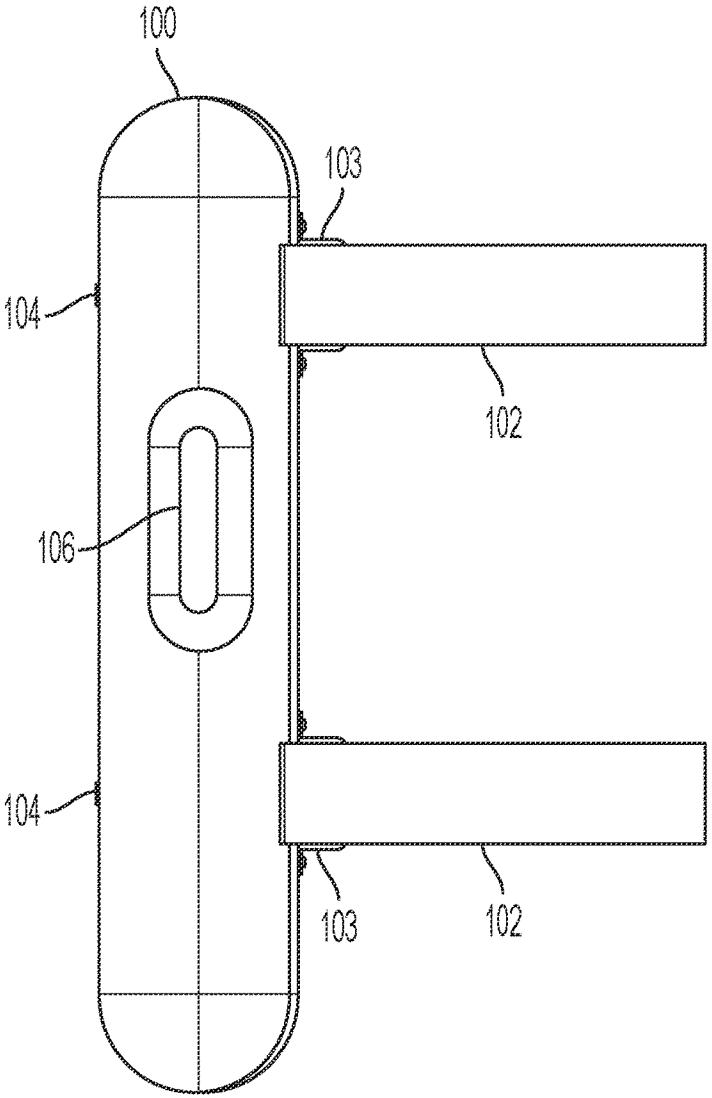
FIG. 7: A side view of a portable dock fender with a resilient band mounting system in the closed (coiled) state.
Figure 9A:
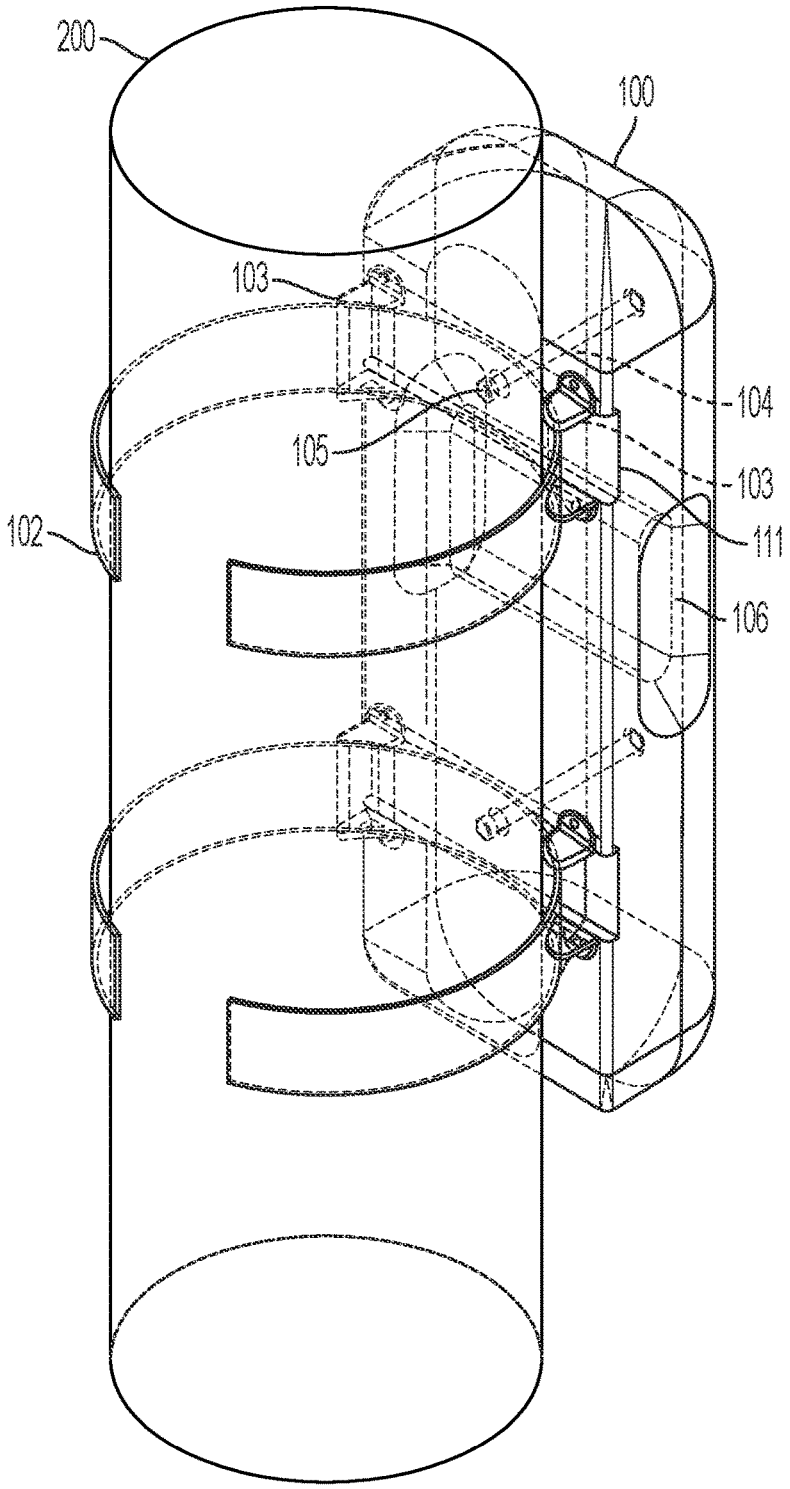
FIG. 9A: A rear perspective view including hidden details of a portable dock fender with a resilient band mounting system installed on a dock pole.
Figure 9B:
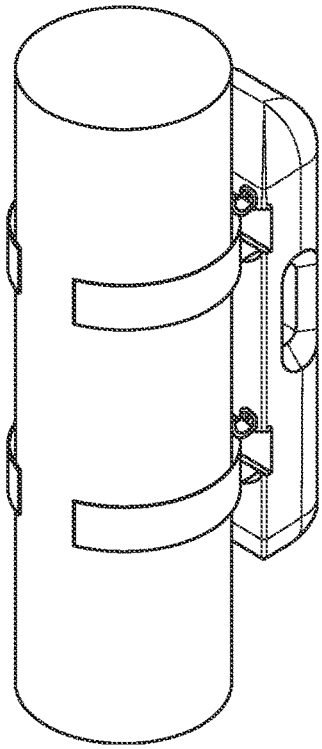
FIG. 9B: A rear perspective view of a portable dock fender with a resilient band mounting system installed on a dock pole.
Figure 9C:
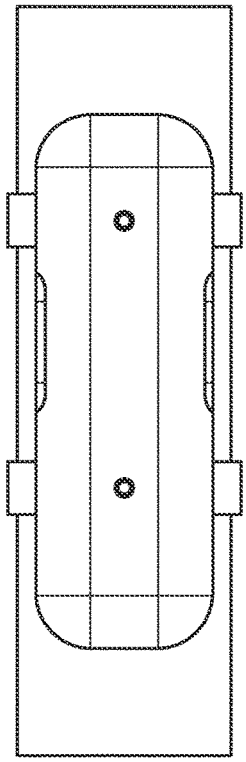
FIG. 9C: A front view of a portable dock fender with a resilient band mounting system installed on a dock pole.
Figure 10:
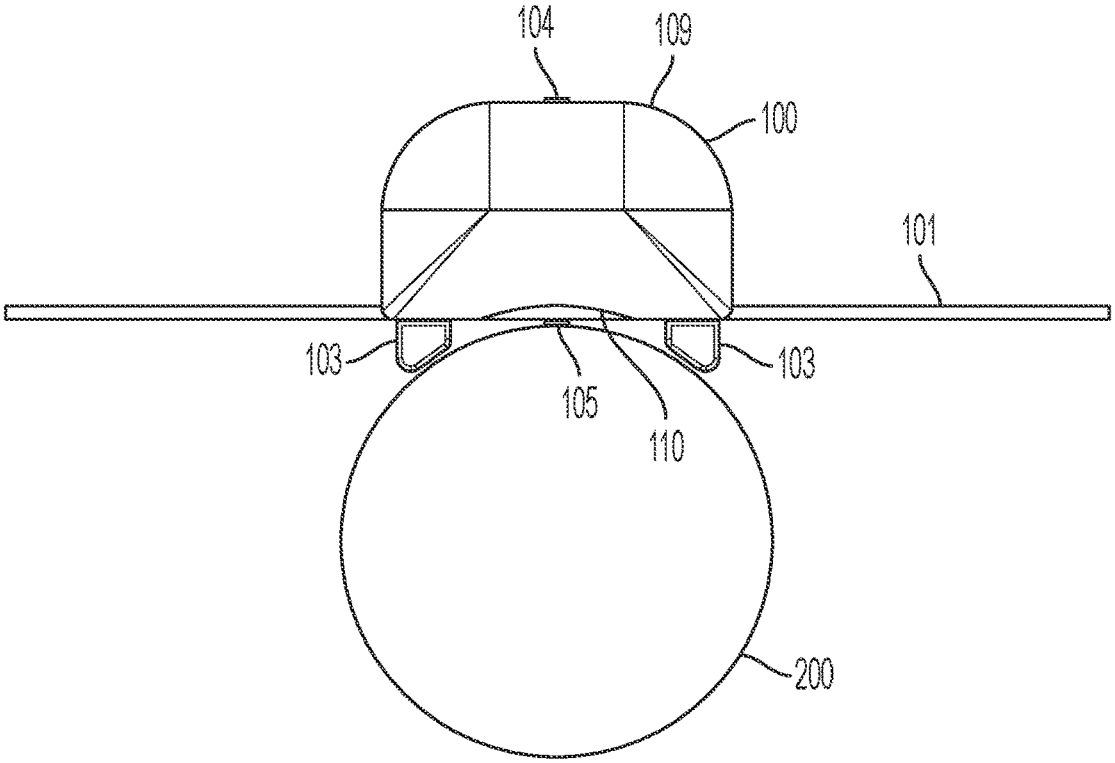
FIG. 10: A top view of a portable dock fender with a resilient band mounting system in the open (straight) state before being installed on a dock pole.
Figure 11:
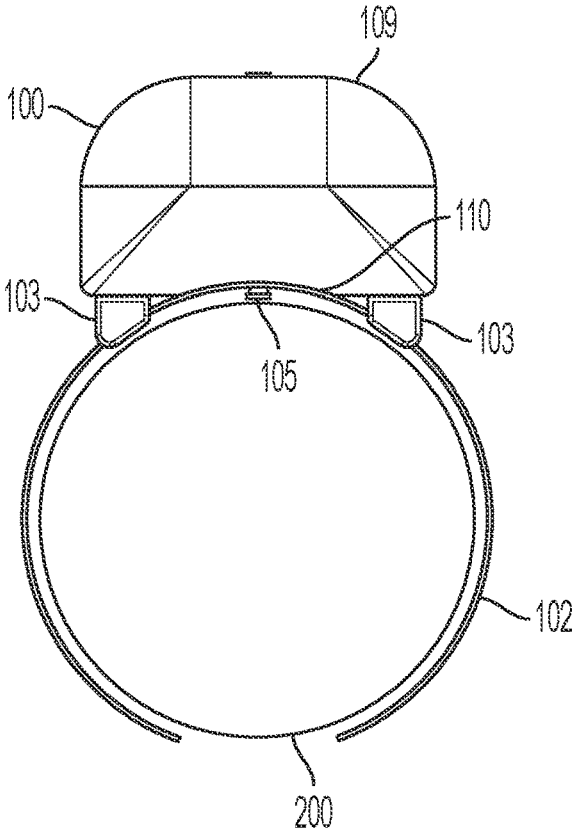
FIG. 11: A top view of a portable dock fender with a resilient band mounting system in the closed (coiled) state and installed on a dock pole.

In some preferred embodiments, the bumper body 100 includes at least one handle 106 for gripping the bumper body 100 to aid in the installation of the device on a dock pole 200. In some embodiments, the handle 106 is integrally molded into the bumper body 100 as a recess into or channel through the body, as shown in FIGS. 7 and 9A. Alternatively, the handle may be a separate part that is attached to the bumper body 100 using fasteners, such as screws or bolts. In a particular preferred embodiment, the bumper includes two handles 106, one on each side, allowing a user to grasp the bumper with both hands. In other embodiments, one or more handles 106 may be attached to (or integrally molded into) the front, top, or bottom surface of the body 100.

Alternatively, the resilient band mounting system may be attached to various other objects besides a portable dock bumper. For instance, the object may be a rod holder, tackle organizer, drink holder, sign holder, paddle holder, a tool holder, a dock line holder, a trash bag holder, a dock light mount, a fishing light mount, a life ring holder, a life vest holder, or a fire extinguisher box. As will be apparent to one of skill in the art, any of the foregoing objects may be readily attached to one or more resilient band mounting systems according to the teachings herein.

The resilient band mounting system also includes a method of securing a device to a post, pole, or other similar structure. Although many posts or poles (e.g. dock pilings) have a circular cross section, the device may be secured to post or poles having a wide range of cross sections, including square or rectangular shapes. The method comprises providing an object, such as a portable dock bumper, comprising at least one resilient band mounting system. The object and resilient band mounting system may be any variation of the embodiments disclosed herein.

The method further comprises placing the at least one band of the resilient band mounting systems in the open or straight state. As discussed elsewhere, the band may be placed in the open or straight state by pulling the ends of the band apart into the straight position and imparting a slight bend into the band along its height or transverse axis.

Once in the open state, the object may be secured to a pole or post by placing the at least one band against the pole or post and applying pressure to the band. The pressure causes the slight bend in the band to depress and the band to spring into its closed or coiled state. In some embodiments, the end cap aids in applying pressure to the band to spring it from the open to the closed state.

In some embodiments, the method further comprises returning the band to the straight state and removing the end cap from the pin. Once removed, the end cap may be replaced, or the pin may be replaced. After the pin and end cap are reassembled, the object may be again secured to a pole or post by placing the band against the pole or post and applying pressure to the band.

While the invention has been described with respect to a limited number of embodiments, those skilled in the art, having benefit of this disclosure, will appreciate that other embodiments can be devised which do not depart from the scope of the invention as disclosed here.

We claim:

1. A portable dock bumper comprising:

a bumper body having a front surface for engaging a vessel and a rear surface for engaging a dock structure, wherein a first through hole extends through said body from said front surface to said rear surface;

a bistable spring band having a first straight position and a second coiled position, wherein said bistable spring band has a height and a through hole located at approximately the midpoint of the height;

a pin disposed in said band through hole and said body through hole, wherein said pin secures said band to said body; and a first bracket disposed around said band on one side of said band through hole.

2. The bumper of claim 1, further comprising a second bracket disposed around said band on the opposite side of said band through hole.

3. The bumper of claim 1, wherein said band has a length and said through hole is located at approximately the midpoint of the length.

4. The bumper of claim 1, wherein said pin comprises an end cap having a diameter greater than the diameter of the band through hole to prevent withdrawal of the pin from the band through hole.

5. The bumper of claim 4, wherein said end cap has a length and is replaceable with another end cap having a smaller or greater length.

6. The bumper of claim 1, wherein said bumper body has a second through hole extending from said front surface to said rear surface, said bumper further comprising:

a second bistable spring band having a first straight position and a second coiled position, wherein said second bistable spring band has a height and a through hole located at approximately the midpoint of its height;

a second pin disposed in said second band through hole and said second through hole of said body, wherein said second pin secures said second band to said body; and a third bracket disposed around said second band on one side of said second band through hole.

7. The bumper of claim 1, wherein said body comprises at least one handle.

8. The bumper of claim 1, wherein the rear surface of said body comprises a concave recess, the deepest portion of said concave recess being aligned with said through hole and said concave recess decreasing in depth a direction toward each said of said body.

9. A resilient band mounting system comprising:

a bistable spring band having a first straight position and a second coiled position, wherein said bistable spring band has a height and a through hole located at approximately the midpoint of the height; and a pin secured in said through hole.

10. The resilient band mounting system of claim 9, wherein said band has a length and said through hole is located at approximately the midpoint of the length.

11. The resilient band mounting system of claim 9, further comprising a first bracket disposed around said band on one side of said through hole.

12. The resilient band mounting system of claim 11, further comprising a second bracket disposed around said band on the opposite side of said through hole.

13. The resilient band mounting system of claim 9, wherein said pin comprises an end cap having a diameter greater than the diameter of the through hole to prevent withdrawal of the pin from the through hole.

14. The resilient band mounting system of claim 13, wherein said end cap has a length and is replaceable with another end cap having a smaller or greater length.

15. The resilient band mounting system of claim 2, wherein said band is a bistable metal spring coated with a protective material.

16. The resilient band mount system of claim 9, wherein said band has a medial line defined as the midpoint of the band's length and said through hole is located on one side of the medial line, and wherein a second through hole is located at approximately the midpoint of the band's height and on the opposite side of the medial line, further comprising:

a second pin secured in said second through hole.

17. The resilient band mounting system of claim 2, further comprising an object having a through hole, wherein said pin is also secured in said through hole of said object.

18. The resilient band mounting system of claim 17, wherein said object has a second through hole, said system further comprising:

a second bistable spring band having a first straight position and a second coiled position, wherein the bistable spring band has a height and a through hole located at approximately the midpoint of its height; and a second pin secured in said through hole of said second band and in said second through hole of said object.

19. A method of installing an object on post or pole comprising:

providing an object having a through hole and comprising:

a bistable spring band having a first straight position and a second coiled position, wherein said bistable spring band has a height and a through hole located at approximately the midpoint of the height; and a pin disposed in said band through hole and said object through hole, wherein said pin secures said band to said object;

placing said band in said first straight position; and placing said band against a post or pole and applying pressure to said band to spring said band into said second coiled position.

20. The method of claim 19, wherein said pin includes an end cap retaining said band on said pin, said method further comprising:

returning said band to said first straight position;

removing said end cap and replacing either said end cap or said pin with a different end cap or different pin; and placing said band against said post or pole and applying pressure to said band to spring said band into said second coiled position.

* * * * *